US005664545A

United States Patent [19]

Kato et al.

[11] Patent Number: 5,664,545

[45] Date of Patent: Sep. 9, 1997

[54] FUEL INJECTION APPARATUS

[75] Inventors: Masaaki Kato; Masahiro Okajima, both of Kariya, Japan

[73] Assignee: Nippondenso Co., Ltd., Kariya, Japan

[21] Appl. No.: 565,755

[22] Filed: Nov. 30, 1995

[30] Foreign Application Priority Data

Dec. 2, 1994 [JP] Japan ..... 6-299839

[51] Int. Cl.[6] ..... F02M 37/04

[52] U.S. Cl. ..... 123/496; 123/467

[58] Field of Search ..... 123/467, 496, 123/506, 500, 501

[56] References Cited

U.S. PATENT DOCUMENTS

| | | | |
|---|---|---|---|
| 4,603,671 | 8/1986 | Yoshinaga | 123/467 |
| 4,640,252 | 2/1987 | Nakamura | 123/467 |
| 4,946,106 | 8/1990 | Turchi | 123/458 |
| 4,972,997 | 11/1990 | Filippi | 123/458 |
| 5,156,132 | 10/1992 | Iwanaga | 123/496 |
| 5,438,968 | 8/1995 | Johnson | 123/467 |
| 5,497,950 | 3/1996 | Mueller | 123/467 |

OTHER PUBLICATIONS

Prescher, et al: "Common–Rail–Einspritzsysteme mit drehzahlunabhangiger charakterstik und hohem einspritzbruch–ein zukunftspotential fur den dieselmotor, IMH co. at the Vienna Motor Sumposium", Apr. 28, 1994, pp. 54–79.

Masahiko Miyaki et al, "Development of New Electronically Controlled Fuel Injection System ECD–U2 for Diesel Engines", SAE International Congress and Exposition, Feb. 25, 1991, Paper No. 910252.

*Primary Examiner*—Carl S. Miller

*Attorney, Agent, or Firm*—Cushman, Darby & Cushman IP Group of Pillsbury Madison & Sutro LLP

[57] ABSTRACT

According to the present invention, a fuel injection apparatus includes a casing having a control pressure chamber for storing fuel supplied from fuel passage, a needle valve to which fuel stored in the control pressure chamber applies pressure in the valve closing direction, a valve device for interrupting communication between the fuel passage and the control pressure chamber to seal fuel in said control pressure chamber, and volume changing device for expanding volume of the control pressure chamber after fuel is sealed in the control pressure chamber by the valve device. According to the above fuel injection device, pressure in the control pressure chamber is reduced while the fuel is stored therein by the volume changing device, the nozzle needle is lifted, and injection is started. For this reason, it is not necessary to supply surplus fuel in addition to the injection fuel during the fuel injection. In this way, the fuel supply pump is made smaller in size, and efficiency for use of supplied fuel can be improved. Further, since high-pressure fuel is not discharged from the fuel injection apparatus, pulsation within the common rail can be suppressed, and fuel injection can be stabilized.

11 Claims, 10 Drawing Sheets

FUEL INJECTION APPARATUS

CROSS REFERENCE TO RELATED APPLICATION

The present application is based on and claims priority from Japanese Patent application No. 6-299839 filed on Dec. 2, 1995, the content of which is incorporated herein by reference.

BACKGROUND OF THE INVENTION

1. Field of the Invention

The present invention relates to a fuel-injection apparatus for an internal combustion engine.

2. Related Art

Conventionally, as illustrated in FIG. 12, the fuel injection apparatus having a control pressure chamber on opposite side of an injection port of a nozzle needle has been known, in which the start timing or the end timing of the fuel injection by the nozzle needle is controlled by adjusting pressure in the control pressure chamber (paper by IMH Co. at the Vienna Motor Symposium).

In FIG. 12, an injector 140 includes a nozzle needle 142 slidably disposed in an axial direction within a casing 141, and fuel which is supplied from a common rail (not illustrated) through a fuel passage 151 to a fuel chamber 146 is injected from an injection opening 147. A piston 144 is disposed reciprocatably with the nozzle needle 142 on an opposite side of the injection opening 147 of the nozzle needle 142. The nozzle needle 142 is urged by a compression coil spring 143 in a closing direction. A control pressure chamber 145 is defined by an end face of the piston 144 on an opposite side of the nozzle needle 142 and an inner wall of the casing 141. Fuel is supplied through the orifice 153 from the fuel passage 152 to the control pressure chamber 145. The control pressure chamber 145 is also connected to a pressure control valve 150 through an orifice 154. The pressure control valve 150 is a two-position and two-port solenoid valve. Leaked fuel within the casing 141 is discharged from a fuel passage 155 to a fuel tank (not illustrated.) When the pressure control valve 150 is closed as shown in FIG. 12, high-pressure fuel from the common rail is supplied to the control pressure chamber 145 without being discharged to the fuel tank 145. Thus, the nozzle needle 142 is closed by the sum of urging force of a compression coil spring 143 and pressure, exerted upon a pressure-receiving surface of the piston 144, of the control pressure chamber 145. Additionally, when the pressure control valve 150 is open, an amount of fuel discharged from the control pressure chamber 145 to the fuel tank through orifice 154 and pressure control valve 150 is greater than an amount of fuel discharged from the common rail to the control pressure chamber 145, because passage area of the orifice 153 is smaller than that of the orifice 154. Accordingly, when pressure within the control pressure chamber 145 declines, the nozzle needle 142 is lifted by the pressure of high-pressure fuel in the fuel chamber 146, and fuel is injected from the injection opening 147.

In the injector 140 illustrated in FIG. 12 high-pressure fuel keeps on being discharged to the fuel tank through the orifice 154, while the pressure control valve 150 is open. Therefore, an additional amount of fuel corresponding to the discharged amount must be supplied to the injector 140 in addition to the amount of injection fuel, and thereby the fuel supply pump for supplying fuel to the common rail becomes large in size and the efficiency of the fuel supply system is deteriorated. Moreover, when the pressure control valve 150 is closed, high-pressure fuel is supplied to the control pressure chamber 145 through the orifice 153 and pressure within the control pressure chamber 145 rises gradually. Therefore, there is a problem in that closing of the nozzle needle is delayed.

In order to solve the above problem of the delay in closing of the nozzle needle, the fuel injection apparatus illustrated in FIG. 13 has been proposed (paper by IMH Co. at the Vienna Motor Symposium). According to this apparatus, a communication between the fuel tank and the control pressure chamber 145 as well as a communication between the common rail and the control pressure chamber 145 are open and closed by a pressure control valve 161 which is a two-position and three-port solenoid valve. A check valve 163 for preventing fuel from flowing from the control pressure chamber 145 to the pressure control valve 161 and a pilot valve 162 having an orifice 164 are provided in a fuel passage. In FIG. 13, an injector 160 is in a closed state. When the pressure control valve moves from a position, where the pressure control valve communicates with the fuel tank, to the position illustrated in FIG. 13 after the fuel injection ends, high-pressure fuel from the common rail is rapidly supplied to the control pressure chamber 145 passing through check valve 163, thereby closing delay of the nozzle valve 142 being prevented.

Even in the fuel injection apparatus illustrated in FIG. 13, however, fuel is discharged from the control pressure chamber 145 to the fuel tank every time fuel is injected, therefore, it is necessary to supply, from the fuel supply pump to the common rail, several times as much fuel as the amount of injection fuel. For this reason, the fuel supply pump becomes large in size, and the diameter of fuel piping to supply fuel to the injector 160 also becomes large, thereby causing a problem in which efficiency of the fuel supply system being deteriorated. Moreover, there is a problem in that the cost is increased because the structure of the pressure control valve 161 is complicated.

SUMMARY OF THE INVENTION

To solve the foregoing problems, it is an object of the present invention to provide a fuel-injection apparatus which can reduce an amount of fuel supplied to an injection valve without reducing an amount of injection fuel.

According to the present invention, a fuel injection apparatus includes a casing having a control pressure chamber for storing fuel supplied from fuel passage, a needle valve to which fuel stored in the control pressure chamber applies pressure in the valve closing direction, a valve device for interrupting communication between the fuel passage and the control pressure chamber to seal fuel in the control pressure chamber, and volume changing device for expanding volume of the control pressure chamber after fuel is sealed in the control pressure chamber by the valve device.

According to the above fuel injection device, pressure in the control pressure chamber is reduced while the fuel is stored therein by the volume changing device, the nozzle needle is lifted, and injection is started. For this reason, it is not necessary to supply surplus fuel in addition to the injection fuel during the fuel injection. In this way, the fuel supply pump is made smaller in size, and efficiency for use of supplied fuel can be improved. Further, since high-pressure fuel is not discharged from the fuel injection apparatus, pulsation within the common rail can be suppressed, and fuel injection can be stabilized.

BRIEF DESCRIPTION OF THE DRAWINGS

Other objects, features and characteristics of the present invention as well as the functions of related parts will become more apparent from a study of the following detailed description, the appended claims, and the drawings.

In the accompanying drawings.

DETAILED DESCRIPTION OF THE PREFERRED EMBODIMENTS

A first embodiment of the present invention will be described with reference to the drawings.

Figure 2:
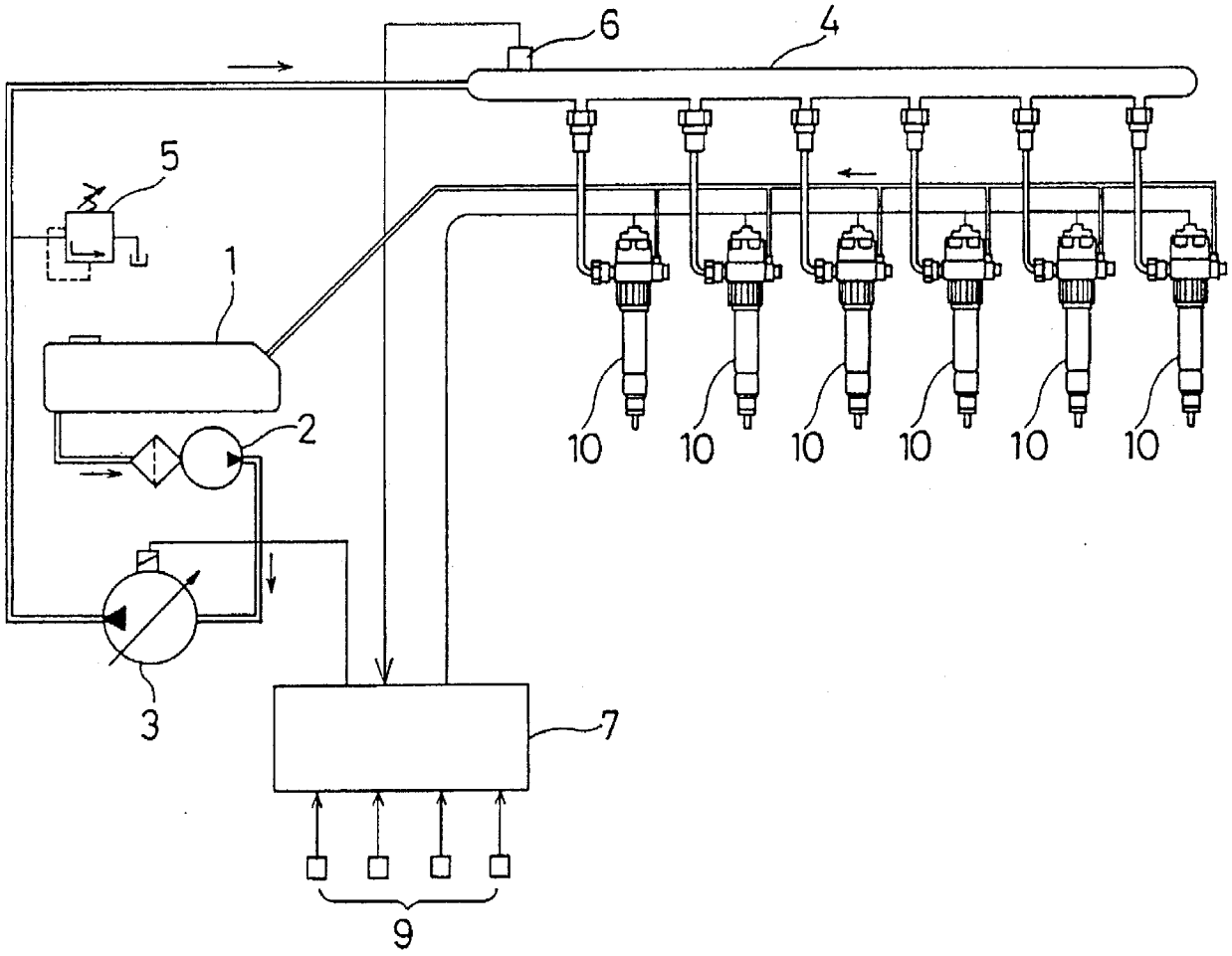
FIG. 2 is a structural diagram illustrating a fuel injection system employing a fuel injection apparatus of the first embodiment.

FIG. 2 illustrates a structure of a fuel-feed system employing a fuel-injection device of the first embodiment according to the present invention.

Fuel, which has been sucked from a fuel tank 1 by a low pressure fuel pump 2, is pressurized by a high pressure fuel pump 3. The pressure of fuel is controlled to a predetermined pressure by a pressure regulator 5, and the fuel is supplied to a common rail 4. The pressure regulator 5 also functions as a safety valve to control the maximum fuel pressure. High pressure fuel kept at a predetermined pressure in the common rail 4 is supplied to an injector 10. Fuel pressure supplied to the injector 10, or injection signals transmitted to the injector 10, is controlled by an electronic control unit (ECU) 7 in accordance with engine speed, load, and environmental conditions based on signals from several sensors 9.

Firstly, feedback control is performed on fuel pressure in accordance with a difference between a detected value of discharge amount of the fuel supply pump 3, which is detected by a pressure sensor 6 installed on the common rail 4, and a pressure target value, and a command output for injection signals is made from the ECU 7 so that the required injection timing and injection quantity are obtained.

Figure 1:
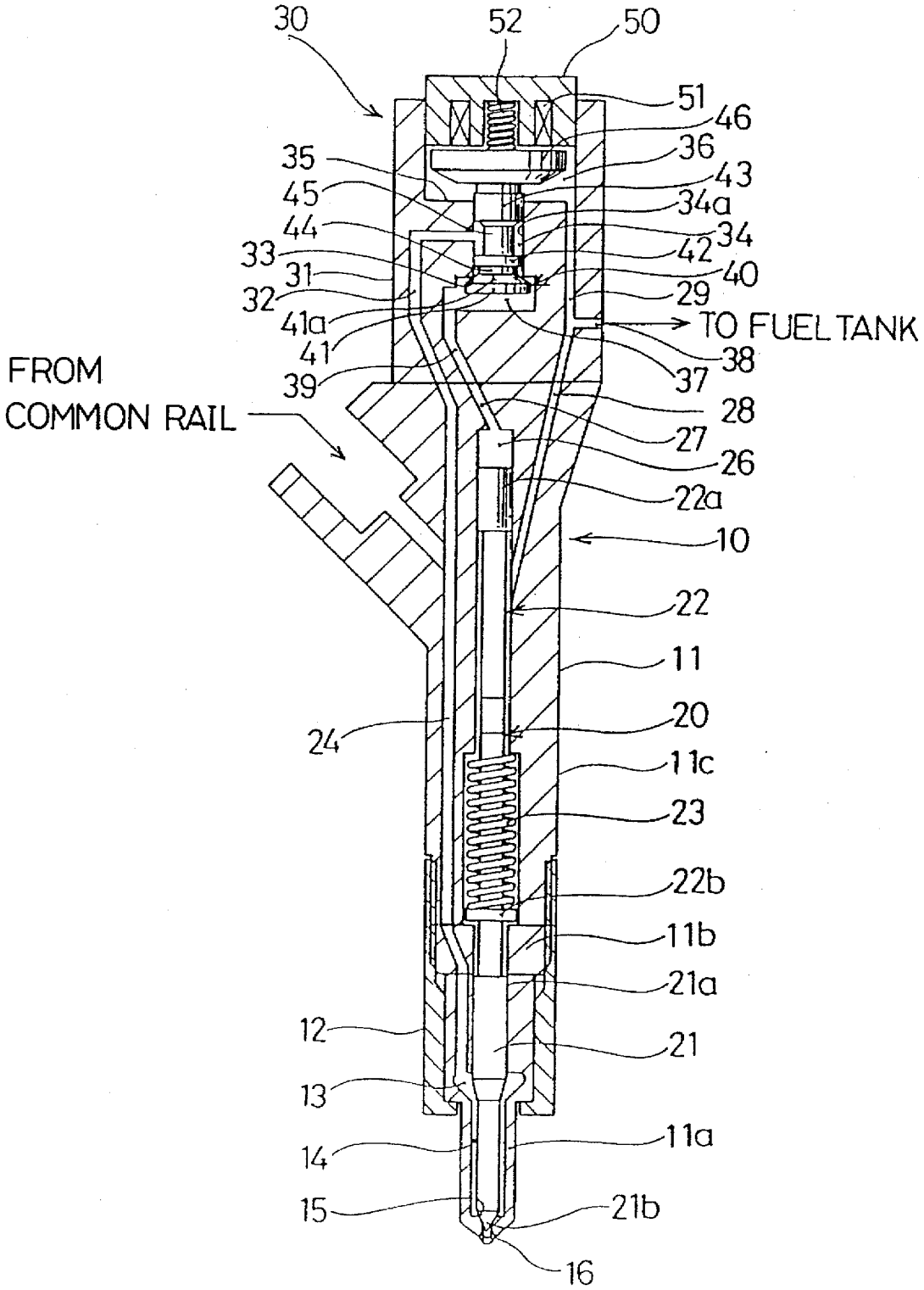
FIG. 1 is a sectional view illustrating a fuel-injection apparatus of a first embodiment according to the present invention.

FIG. 1 illustrates a detailed structure of the injector 10. A casing member 11 of the injector 10 is composed of a valve casing 11*a*, a tip gasket 11*b*, and a body lower 11*c*. The valve casing 11*a*, the tip gasket 11*b*, and the body lower 11*c* are integrally joined by a retaining ring 12. A sliding hole 14 is formed axially in the casing member 11, and a needle valve 20 composed of a nozzle needle 21 and a piston 22 is reciprocatably disposed in the axial direction of the sliding hole 14. A fuel chamber 13 and an injection opening 16 are formed in the valve casing 11*a* so as to communicate with the sliding hole 14, and a guide portion 21*a* of the nozzle needle 21 is slidably guided by an inner wall of the casing member 11 which forms the sliding hole 14. A valve body 21*b* is integrally formed on a tip of this nozzle needle 21, and fuel injection from the injection opening 16 is switched on and off by the valve body 21*b* being unseated from and seated in a valve seat 15.

The piston 22 has a retainer 22*b*, which contacts the nozzle needle 21, at one end portion, and a compression coil spring 23 is retained by the retainer 22*b*. The piston 22 has a sliding portion 22*a*, which slides with the inner wall of the casing member 11 forming the sliding hole, at the other end portion, and space on each side in the axial direction of this sliding portion 22*a* is enclosed by the sliding portion 22*a*. The nozzle needle 21 is urged in a valve closing direction together with the piston 22 by the compression coil spring 23.

A solenoid valve 30 is provided above the casing member 11. A valve casing 31 of the solenoid valve 30 houses a pressure control valve 40 slidably disposed in an axial direction within a sliding hole 34, and a wound coil 51 is housed within a solenoid casing 50.

The pressure control valve 40 is composed of a needle 41, a land portion 42, and a guide portion 43, and small-diameter first and second connecting portions 44 and 45 which respectively connect between the needle 41 and land portion 42 and between the land portion 42 and guide portion 43. A seat portion 41*a* of the needle 41 seats on a valve seat 33 in an upward direction of FIG. 1 or unseats from the valve seat 33 in a downward direction of FIG. 1. The land portion 42 slides with an inner wall 34*a* forming the sliding hole 34 in a manner to form a clearance of several microns therebetween.

Additionally, the fuel passage 32 is open in a fuel chamber within the pressure control valve 40, which is formed by the inner wall, first connecting portion 45, land portion 42, and guide portion 43. Therefore, high pressure from the fuel passage 32 is applied to a side wall of the needle 41, and reciprocating movement of the needle 41 within the inner wall is thereby facilitated.

An armature 46 is secured to an end portion of the guide portion 43 by press-fitting, welding, threads, or the like, and reciprocates together with the pressure control valve 40. Downward movement of the armature 46 is restricted by a retainer 35' of the valve casing 31. When electric current to the coil 51 is switched off, the needle 41 is unseated from the valve seat 33 by urging the armature 46 downwardly with the urging force of the compression coil spring 52. At this time, the land portion 42 moves downward to the pressure chamber 37 disposed below the needle 41, and the pressure chamber 37 communicates with a tubular space formed around connecting portion 45. When electric current to the coil 51 is switched on, the armature 46 is attracted toward the coil 51, i.e., the upward direction of FIG. 1. Thus, the pressure control valve 40 is lifted and the needle 41 is seated on the valve seat 33. At this time, the communication between the pressure chamber 37 and the space formed around the connecting portion 45 is interrupted.

High-pressure fuel having been supplied from the common rail 4 to the injector 10 is supplied to the fuel chamber 13 from a fuel passage 24, a first fuel passage formed in the casing member 11. Pressure of fuel supplied to the fuel chamber 13 urges the nozzle needle 21 in a valve opening direction. High-pressure fuel having been supplied from the common rail 4 to the injector 10 is also supplied to the sliding hole 34 from a fuel passage 32, a second fuel passage formed in the valve casing 31.

A pressure chamber 26 formed above the piston 22 communicates with the pressure chamber 37 formed below the pressure control valve 40 by a fuel passage 27 formed in the casing member 11 and a fuel passage 39 formed in the valve casing 31, and the pressure chamber 26, fuel passage 27, fuel passage 39, and pressure chamber 37 function as a control pressure chamber to apply pressure to the piston 22. In this embodiment, the fuel passage 27 and fuel passage 39 communicates with an outer periphery of the pressure chamber 37, but these passages can communicate with a central portion instead of the outer periphery of the pressure chamber 37. Furthermore, the sliding hole 14 between the sliding portion 22*a* of the piston 22 and the guide portion 21*a* of the nozzle needle 21 communicates with a housing hole 36 which houses the armature 46 through a fuel passage 28 formed in the casing member 11 and a fuel passage 29 formed in the valve casing 31, and surplus fuel within the sliding hole 14 and housing hole 36 is discharged to the fuel tank from a fuel discharge port 38 communicating with the fuel passage 29.

An operation of the injector 10 will be described hereinafter.

FIG. 1 illustrates a state wherein electric current is supplied to the coil 51. The armature 46 is attracted toward the coil 51 by magnetic field generated in the coil 51 resisting the urging force of the compression coil spring 52, thereby the pressure control valve 40 is lifted upwardly together with the armature 46. When the land portion 42 passes the valve seat 33 and is pulled upwardly within the sliding hole 34, communication between the space formed around the first connecting portion 45 and the pressure chamber 37 are interrupted by the land portion 42. Thus, high-pressure fuel is no longer supplied to the pressure chamber 37. When the pressure control valve 40 is further lifted together with the armature 46 and the needle 41 is seated on the valve seat 33, the pressure control valve 40 is stopped. Since the control pressure chamber increases in its volume by a volume Vs, which is obtained by multiplying a movement distance of further movement upwardly of the land portion 42 after communication between the space formed around the connecting portion and the pressure chamber 37 is interrupted with the cross-sectional surface area of the land portion 42, while storing a predetermined amount of fuel defined by the pressure chamber 26, fuel passage 27, fuel passage 39, and pressure chamber 37, the pressure of the pressure chamber 36 drops. Then, the combined force of the force which urges the piston 22 downwardly in accordance with pressure within the pressure chamber 26 and the compression coil spring 23 gets weaker than the force obtained by multiplying the pressure of fuel supplied from the common rail 4 with the pressure-receiving surface area when the nozzle needle 21 is closed. Then, the nozzle needle is unseated from the valve seat 15, and high-pressure fuel is injected from the injection opening 16.

The force relationship at this time is described. When the pressure-receiving cross sectional surface area of the sliding portion 22*a* is taken to be Ap, the cross-sectional surface area of the guide portion 21*a* of the nozzle needle 21 is taken to be An, the pressure of fuel supplied from the common rail 4 is taken to be Pc, the pressure within the pressure chamber 26 is taken to be Pp, and load of the compression coil spring 23 is taken to be Fsp, a valve opening condition of the nozzle needle 21 is expressed by the following equation (1).

$$Ap \times Pp + Fsp < (An - As) \times Pc \quad (1)$$

Figure 4A:
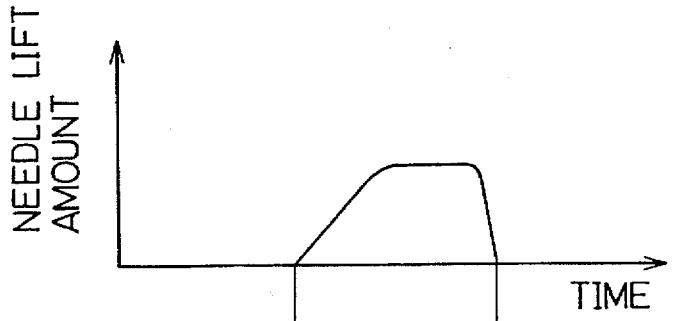
FIGS. 4A and 4B are characteristic diagrams showing a relationship between amount of lift of a nozzle needle and pressure within a control pressure chamber of the first embodiment.
Figure 4B:
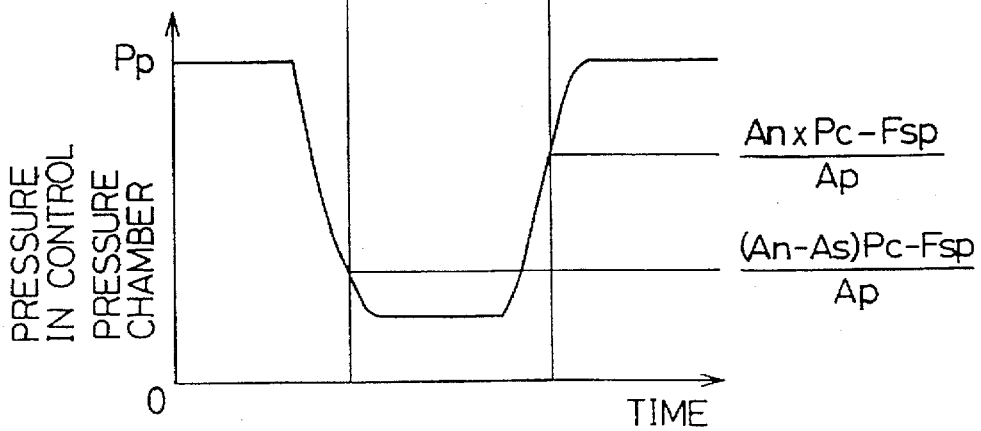

That is to say, when pressure Pp of the pressure chamber 26 drops in a manner to satisfy the following equation (2), the nozzle needle 21 is lifted and fuel injection begins, as shown in FIG. 4. Pressure Pp is set not less than zero (equivalent to atmospheric pressure) to prevent cavitation from occurring due to the pressure reduction by the land portion 42.

$$0 < Pp < \{(An - As) \times Pc - Fsp)/Ap \quad (2)$$

Figure 3:
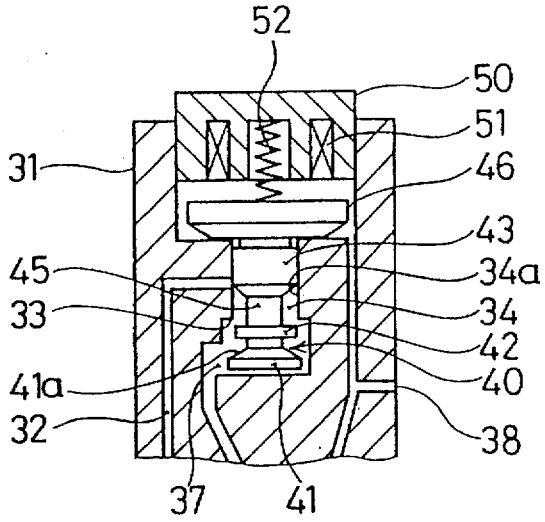
FIG. 3 is a sectional view illustrating a main portion of the first embodiment.

FIG. 3 illustrates a state where electric current to the coil 51 is off. When electric current to the coil 51 is switched off, the armature 46 is urged downwardly in FIG. 3 by the urging force of the compression coil spring 52, and the pressure control valve 40 also moves downwardly together with the armature 46. Then, the land portion 42 further moves lower than the position where the land portion 42 slides with the inner wall 34*a* and protrudes within the pressure chamber 37, and so the space formed around the first connecting portion 45 and the pressure chamber 37 are communicated. That is to say, high-pressure fuel supplied from the common rail 4 is supplied from the fuel passage 32, space formed around the connecting portion 45, pressure chamber 37, and fuel passage 39, through the fuel passage 27, and to the pressure chamber 26. When pressure Pp within the pressure chamber 26 is satisfied with the following equations (3) and (4), the nozzle valve 21 begins to be lowered and stops when the valve body 21*b* seats on the valve seat 15, as shown in FIG. 4.

$$Ap \times Pp + Fsp > An \times Pc \quad (3)$$

From equation (3), $$Pp > (An \times Pc - Fsp)/Ap \quad (4)$$

Volume change Vp of the pressure chamber 26 by the movement of the piston 22 is set to be smaller than volume change Vs by the land portion 42, and volume of the space which is the control pressure chamber defined and formed between the land portion 42 and the sliding portion 22*a* increases as the pressure control valve 40 moves upwardly, thereby pressure within the pressure chamber 26 being dropped.

According to the first embodiment, it is simplified to control the opening and closing of the nozzle needle 21 by the pressure within the pressure chamber 26 which is regulated by changing the volume with the reciprocating movement of the pressure control valve 40. High-pressure fuel other than for fuel injection from the injection opening 16 is not discharged from the injector 10 at this time, and therefore the amount of fuel supplied from the common rail to the injector 10 can be reduced. That is to say, since the discharge amount of the fuel supply pump can be reduced, the size of the fuel pump can be made smaller. Further, even if the volume of the common rail is reduced, a high-efficiency injection apparatus can be obtained while maintaining pressure at a predetermined pressure.

Figure 5:
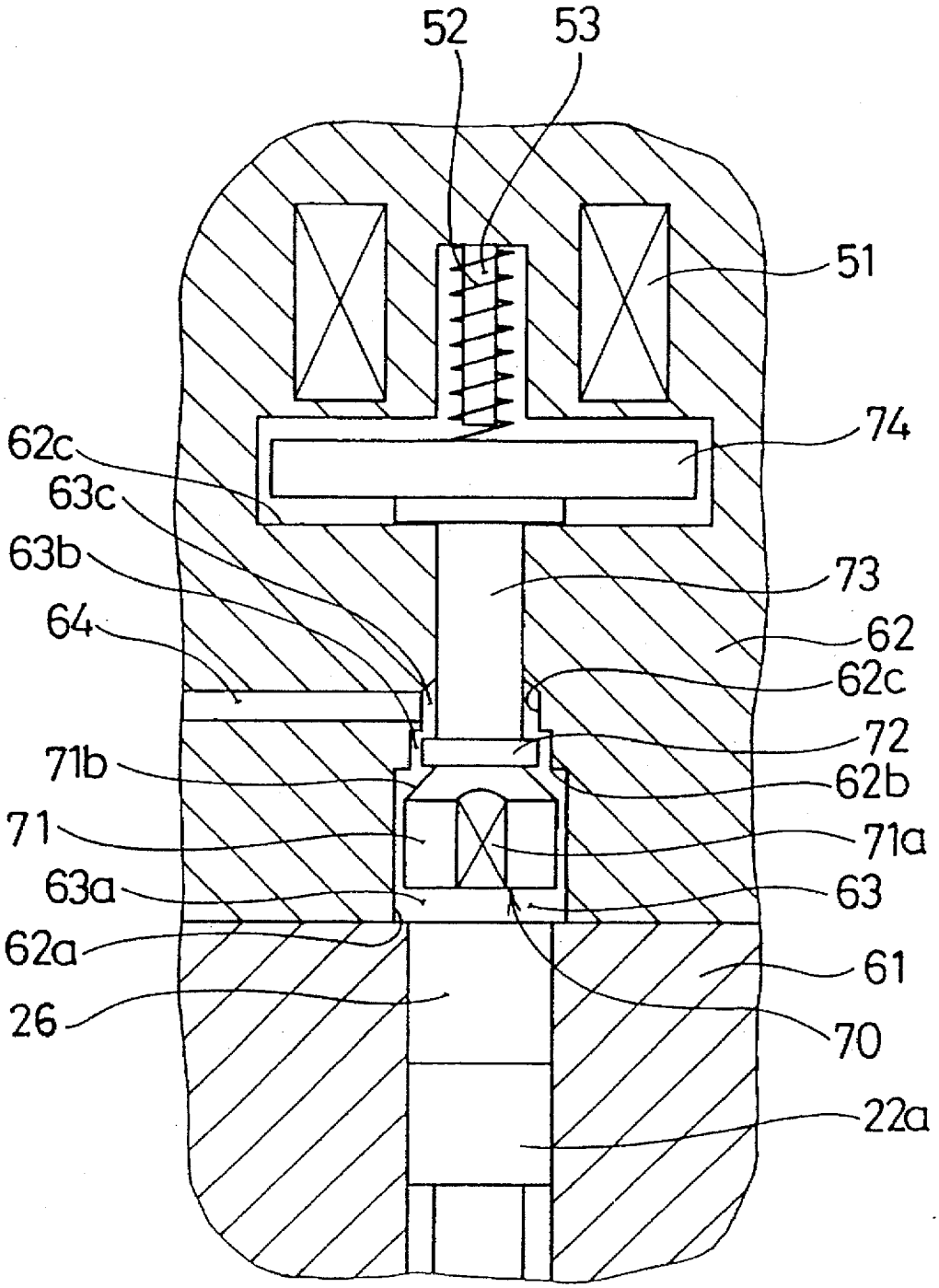
FIG. 5 is a sectional view illustrating a fuel injection apparatus of a second embodiment according to the present invention.

A second embodiment according to the present invention is described with respect to FIG. 5.

According to the second embodiment, a pressure chamber 26 formed by an inner wall of a casing 61 and a pressure chamber formed by an inner wall of a valve casing 62 directly communicate with each other, thereby forming a control pressure chamber. The pressure chamber 63 is formed by a large-diameter chamber 63*a*, a medium-diameter chamber 63*b*, and a small-diameter chamber 63*c* disposed in this order from the bottom in FIG. 5.

A pressure control valve 70 is composed of a needle 71, a land portion 72, and a guide portion 73, and an armature 74 is fixed to an end portion of the guide portion 73. A notch 71*a* is formed axially in an outer peripheral wall of a cylindrical portion of the needle 71 which functions as a fluid-resistance portion. A seat portion 71*b* of the needle 71 seats on or unseats from a valve seat 62*b* provided on a junction portion between the large-diameter chamber 63*a* and medium-diameter chamber 63*b*, and a clearance between the outer peripheral wall of the needle 71 and an inner wall 62*a* of the valve casing 62, which forms the large-diameter chamber 63*a* with the outer peripheral wall of the needle 71, made narrower than that of the first embodiment. The land portion 72 is slidable with an inner wall 62*c* of the valve casing 62 which forms the small-diameter chamber 63*c*. High-pressure fuel supplied from a common rail (not illustrated) is supplied to a fuel chamber formed around a tip end of a nozzle needle (not illustrated). Meanwhile fuel is supplied from a fuel passage 64 to the small-diameter chamber 63*c*, and further to the pressure chamber 26 through the large-diameter chamber 63*a*.

When electric current to a coil 51 is switched on, the armature 74 is attracted toward the coil 51 by magnetic force generated by the coil 51, and the pressure control valve 70 is lifted together with the armature 74. Firstly, the land portion 72 slides to the inner wall 62*c*, and interrupts communication between the fuel passage 64 and medium-diameter chamber 63*b*. When the pressure control valve 70 is further lifted together with the armature 74, the volume of the pressure chamber 63 below the land portion 72 increases, and the pressure of the pressure chamber 26 drops. Since the clearance between the outer peripheral wall of the valve body 71 and the inner wall 62*a* is narrow in this embodiment, lifting speed of the pressure control valve 70 is reduced to be less than that of the first embodiment by throttling the fuel passage with the narrow clearance. When the pressure control valve 70 is gradually lifted, pressure within the pressure chamber 26 also gradually drops. Then, the nozzle needle is gradually lifted, and fuel injection is started. For this reason, noise during the start of fuel injection is reduced, a rise of the injection rate in the beginning gets slower. Therefore, combustion in the combustion chamber gets slower and combustion noise as well as generation of nitrogen oxides can be restrained.

When electric current to the coil 51 is switched off, the armature 74 is lowered, and the fuel passage 64 communicates with the pressure chamber 26. At this time, fuel having been supplied from the fuel passage 64 is rapidly supplied to the pressure chamber 26 passing between the notch 71*a* and inner wall 62*a*, and pressure within the pressure chamber 26 also rises rapidly. Then, the nozzle needle is closed.

Since the small-diameter chamber 63*c* is formed by providing a concave portion in the inner wall of the valve casing 62, not by the pressure control valve 70, sealing length in the axial direction of the guide portion 73 and valve casing 62 can be made longer. In this way, the static fuel amount which leaks toward the armature 74 from the clearance between the guide portion 73 and valve casing 62 can be reduced.

Furthermore, according to the second embodiment, the pressure control valve 70 is stopped by the valve body 71 being seated on the valve seat 62*b*, but the pressure control valve 70 can be stopped by the armature 74 contacting a stopper 53 before the valve body 71 seats on the valve seat 62*b*.

Figure 6:
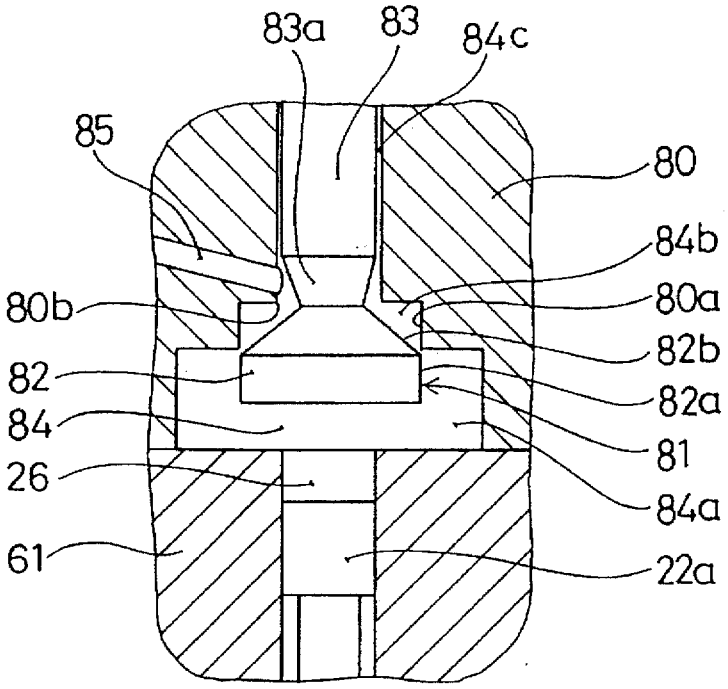
FIG. 6 is a sectional view illustrating a fuel injection apparatus of a third embodiment according to the present invention.

A third embodiment according to the present invention is described with respect FIG. 6.

A pressure chamber 84 formed by an inner wall of a valve casing 80 directly communicates with a pressure chamber 26, thereby forming a control pressure chamber. The pressure chamber 84 includes a large-diameter chamber 84*a*, a small-diameter chamber 84*b*, and a sliding hole 84*c* having a smaller diameter than the small-diameter chamber 84*b*, which are arranged in this order from the side of the pressure chamber 26.

A pressure control valve 81 is composed of a valve body 82 and a guide portion 83 formed in a cylindrical shape, which are integrally formed. The valve body 82 is composed of a cylindrical portion 82*a* having a short axial length and a seat portion 82*b* formed in a tapered shape having a cross-section which is inclined inwardly in the radial direction, and is connected to a guide portion 83 by a connecting portion 83*a* formed in a tapered shape having a cross-section which is inclined inwardly in the radial direction toward the seat portion 82*b*. An outer peripheral wall of the cylindrical portion is slidable with an inner wall 80*a* of the valve casing 80, and the seat portion 82*b* seats on or unseats from a valve seat 80*b* formed in an inner wall of the valve casing 80 at a junction portion between the small-diameter chamber 84*b* and sliding hole 84*c*.

When electric current to a coil (not illustrated) is switched on, the pressure control valve 81 is lifted, and the cylindrical portion 82*a* slides with the inner wall 80*a*. In this way, communication between a fuel passage 85 to which fuel is supplied from a common rail and the pressure chamber 26 is interrupted. When the pressure control valve 81 is further lifted, volume of the large-diameter chamber 84*a* except for the pressure control valve 81 is increased, and thereby pressure of the pressure chamber 26 begins to drop. Accordingly, a nozzle needle (not illustrated) is lifted, and fuel injection is started. When the pressure control valve 81 is lifted further, the seat portion 82*b* seats on the valve seat 80*b*.

When electric current to the coil (not illustrated) is switched off, the pressure control valve 81 is lowered, and the fuel passage 85 communicates with the pressure chamber 26. Then, the pressure of the pressure chamber 26 rises, and the nozzle needle is open.

According to the third embodiment, since the valve body 82 functions both for opening and closing of the pressure control valve 81 and for regulating the pressure of the pressure chamber 26 and an additional land portion is not required separately from the valve body as in the second embodiment, the shape of the pressure control valve 81 is simplified. Furthermore, according to the present embodiment, the valve body can slide on the inner wall forming a sliding hole in which the guide portion slides by setting the outer diameters of the valve body being equal to that of the guide portion. In such a case, an upward moving distance of the pressure control valve is restricted by, for example, the stopper 53 illustrated in FIG. 5.

Figure 7:
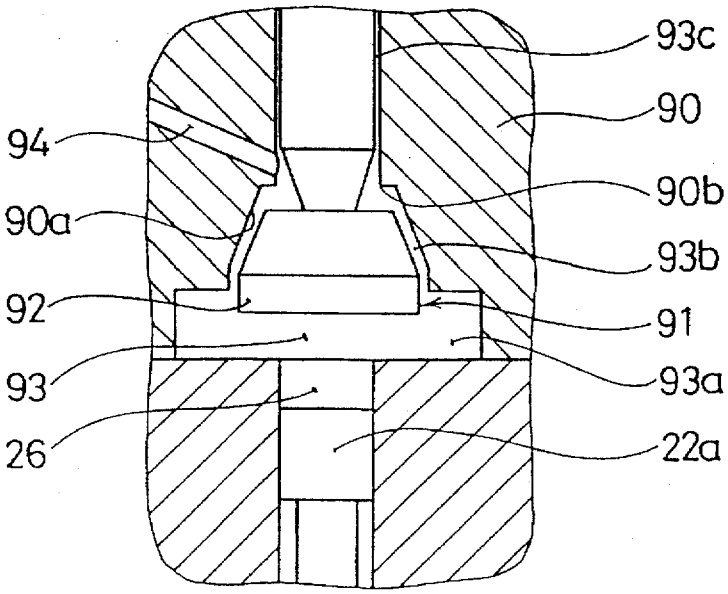
FIG. 7 is a sectional view illustrating a fuel injection apparatus of a fourth embodiment according to the present invention.

A fourth embodiment according to the present invention is described with respect to FIG. 7.

A pressure chamber 93 formed by an inner wall of a valve casing 90 directly communicates with a pressure chamber 26, and thereby forming a control pressure chamber. The pressure chamber 93 has a small-diameter chamber 93*b* which is inclined inwardly in the radial direction from a large-diameter chamber 93*a* toward a sliding hole 93*c* in correspondence with the shape of a valve body 92 of a pressure control valve 91. High-pressure fuel from a common rail is supplied to the pressure chamber 93*a* through fuel passage 94.

When electric current to a coil (not illustrated) is switched on and the pressure control valve 91 is lifted, a clearance between an outer peripheral wall of the valve body 92 and an inner wall 90*a* forming the small-diameter chamber 93*b* is gradually throttled. Then, passage area formed between the outer peripheral wall of the valve body 92 and the inner wall 90*a* is reduced, and the clearance formed between the outer peripheral wall of the valve body 92 and the inner wall 90*a* functions as a fluid-resistance portion. That is to say, fuel which is supplied from the fuel passage 94 so as to fill the increased volume by the lifting movement of the pressure control valve 91 cannot keep up with the lifting speed of the pressure control valve 91 due to the fluid-resistance portion. As the same result with the increase in the volume of the pressure chamber 93, and pressure of the pressure chamber 26 drops. Then, a nozzle needle is open, and fuel injection is started. When the pressure control valve 91 is further lifted, the valve body 92 seats on a valve seat 90*b*.

According to the fourth embodiment, since the clearance formed between the outer peripheral wall of the valve body 92 and the inner wall 90*a* gradually gets narrower as the pressure control valve 91 is lifted, the passage is gradually throttled, and a rise of the injection rate in the beginning can get slower. Therefore, combustion in the combustion chamber gets slower and combustion noise as well as generation of nitrogen oxides can be restrained.

Furthermore, according to the fourth embodiment, and lifting of the pressure control valve 91 is stopped by the valve body 92 seating on the valve seat 90*b*, but it is acceptable that a pressure control valve 91 being stopped by a tapered surface of a valve body contacting with an inner wall for forming a small-diameter chamber.

Figure 8:
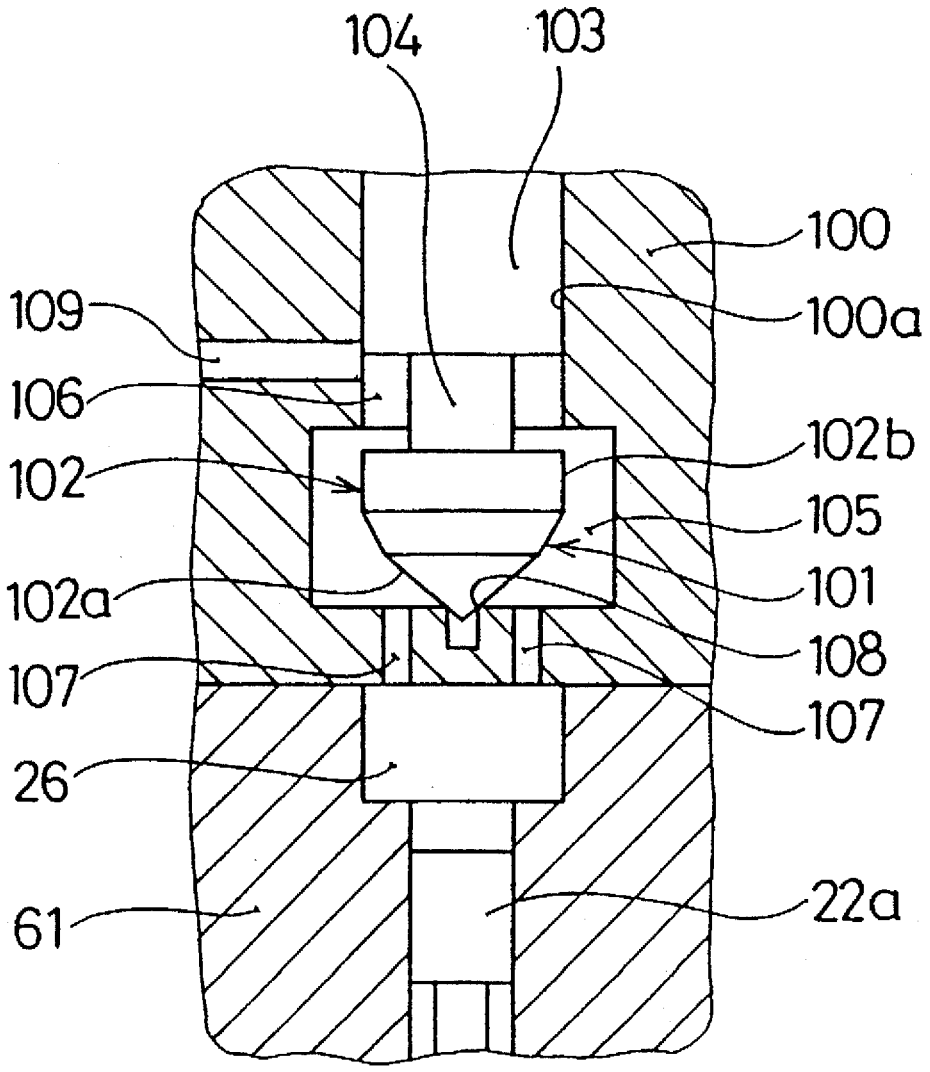
FIG. 8 is a sectional view illustrating a fuel injection apparatus of a fifth embodiment according to the present invention.

A fifth embodiment according to the present invention is described with respect to FIG. 8.

A pressure chamber 105 formed by an inner wall of a valve casing 100 directly communicates with a pressure chamber 26 through a communication hole 107, and thereby forming a control pressure chamber. A sliding hole 106 is formed above the pressure chamber 105.

A pressure control valve 101 is composed of a valve body 102 which is downwardly narrowed, a guide portion 103 which slides on an inner wall 100*a* forming a sliding hole 106, and a connecting portion 104 of a diameter smaller than the guide portion 103 which connects the valve body 102 with the guide portion 103, which are integrally joined. An outer diameter of the valve body 102 is equal to an outer diameter of the guide portion 103. A tip portion 102*a* of the valve body 102 is formed in a conical shape, and seats on or unseat from a valve seat 108 formed in the valve casing 100. A guide portion 102*b* disposed on the side of the connecting portion 104 of the valve body 102 slides with the inner wall 100*a*.

When electric current to a coil (not illustrated) is switched on and the pressure control valve 101 is lifted, an outer peripheral wall of the guide portion 102*a* of the valve body 102 slides with the inner wall 100*as*, and communication between the pressure chamber 105 and a fuel passage 109 to which fuel is supplied from a common rail is interrupted. When the pressure control valve 101 is lifted further, volume of the pressure chamber 105 except for the pressure control valve 101 is increased, and pressure of a pressure chamber 26 begins to drop. Then, a nozzle needle (not illustrated) is lifted, and fuel injection is started. When the pressure control valve 101 is lifted further, an armature (not illustrated) which is lifted together with the pressure control valve 101 contacts with a stopper (not illustrated), and lifting of the pressure control valve 101 is stopped.

When electric current to the coil (not illustrated) is switched off, the pressure control valve 101 begins to be lowered, the fuel passage 109 communicates with the pressure chamber 105, and a nozzle needle is open. The pressure control valve 101 is stopped by the valve body 102 seating on the valve seat 108.

According to the fifth embodiment, since the outer diameters of the valve body 102 is equal to that of the guide portion 103, it is easy to manufacture the valve casing 100. Furthermore, since the armature and the pressure control valve 101 can be corporated into the valve casing 100 from the upper side in FIG. 8 while these two parts are assembled together, it is possible to assemble easily and to simplify the assembling work.

Figure 9:
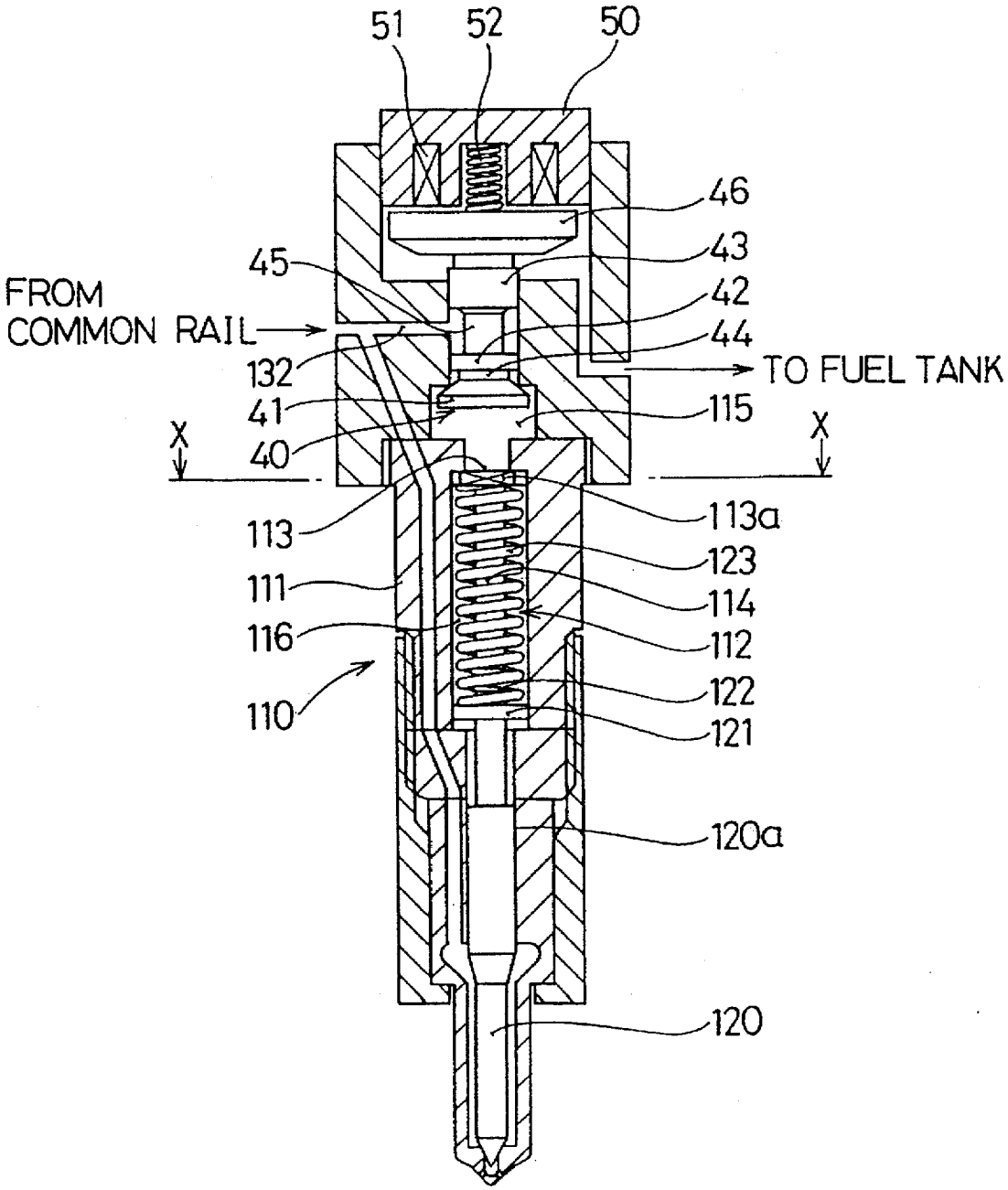
FIG. 9 is a sectional view illustrating a fuel-injection apparatus of a sixth embodiment according to the present invention.
Figure 10:
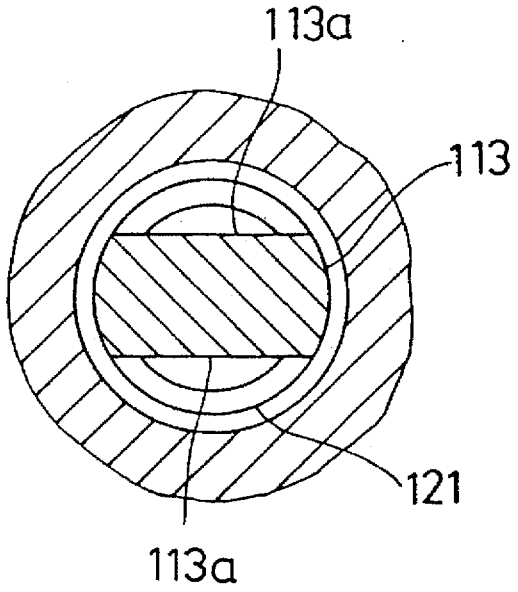
FIG. 10 is a sectional view taken along line X—X of FIG. 10.

A sixth embodiment according to the present invention is described with respect to FIGS. 9 and 10.

As shown in FIG. 9, a nozzle valve composed of a needle 120 and a stopper 112 is disposed in a sliding hole provided in an axial direction of a casing member 111. The stopper 112 is composed of a retainer 113 and a rod 114, and opposes the nozzle needle 120 so as to form a clearance in the axial direction. For this reason, even if the nozzle needle 120 is lifted rapidly when the nozzle needle 120 is open, the nozzle needle 120 is stopped by a tip of the rod 114. As shown in FIG. 10, the retainer 113 formed in a disk shape is provided with notches 113*a* at each side face.

A retainer 121 for a compression coil spring 123 is provided on the nozzle needle 120 at the side of stopper 112, and a pin 122 with which the compression coil spring 123 engages is provided on an upper-end surface of the retainer 121. This pin 122 opposes the rod 114.

Fuel within a pressure chamber 115 is enclosed by a guide portion 120*a* of the nozzle needle 120 which slides with an inner wall of the casing member 111, and a control pressure chamber which includes the pressure chamber 115 is formed between a land portion 42 and the guide portion 120*a*. That is to say, the guide portion 120*a* of the nozzle needle 120 functions as a piston. According to this structure, urging force of the compression coil spring 123 which urges the nozzle needle 120 in the valve-closing direction is not adjusted in accordance with a difference in cross-sectional surface areas of a piston and the nozzle needle as in the first embodiment and it is possible to design in consideration of only the cross-sectional area of the nozzle needle 120.

According to the sixth embodiment, overall length of an injector 110 can be shortened to nearly half in comparison with the first embodiment by the nozzle needle 120 functioning as a piston. Moreover, there is no need to form a fuel passage to return leaked fuel within the casing member 111 to a fuel tank, thereby the manufacturing process be simplified.

Additionally, since the stopper 112 opposes the nozzle needle 112 so as to form a clearance in the axial direction, useless volume in a needle spring chamber 116 can be reduced.

Figure 11:
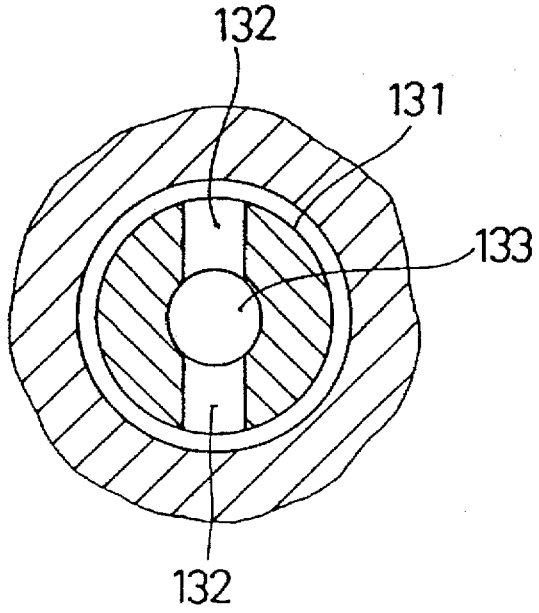
FIG. 11 is a sectional view illustrating a modification of the sixth embodiment.
Figure 12:
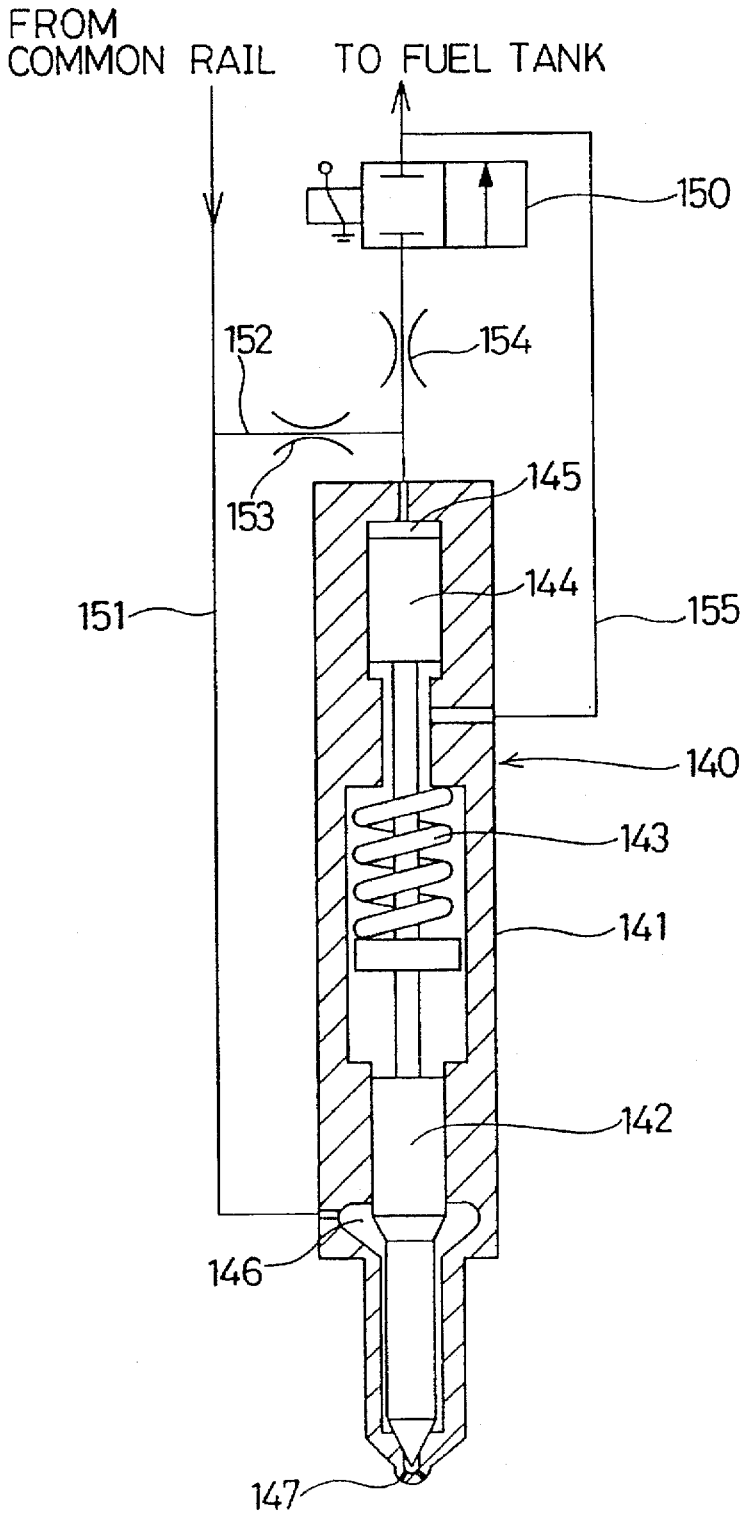
FIG. 12 is a sectional view illustrating a conventional fuel injection apparatus.
Figure 13:
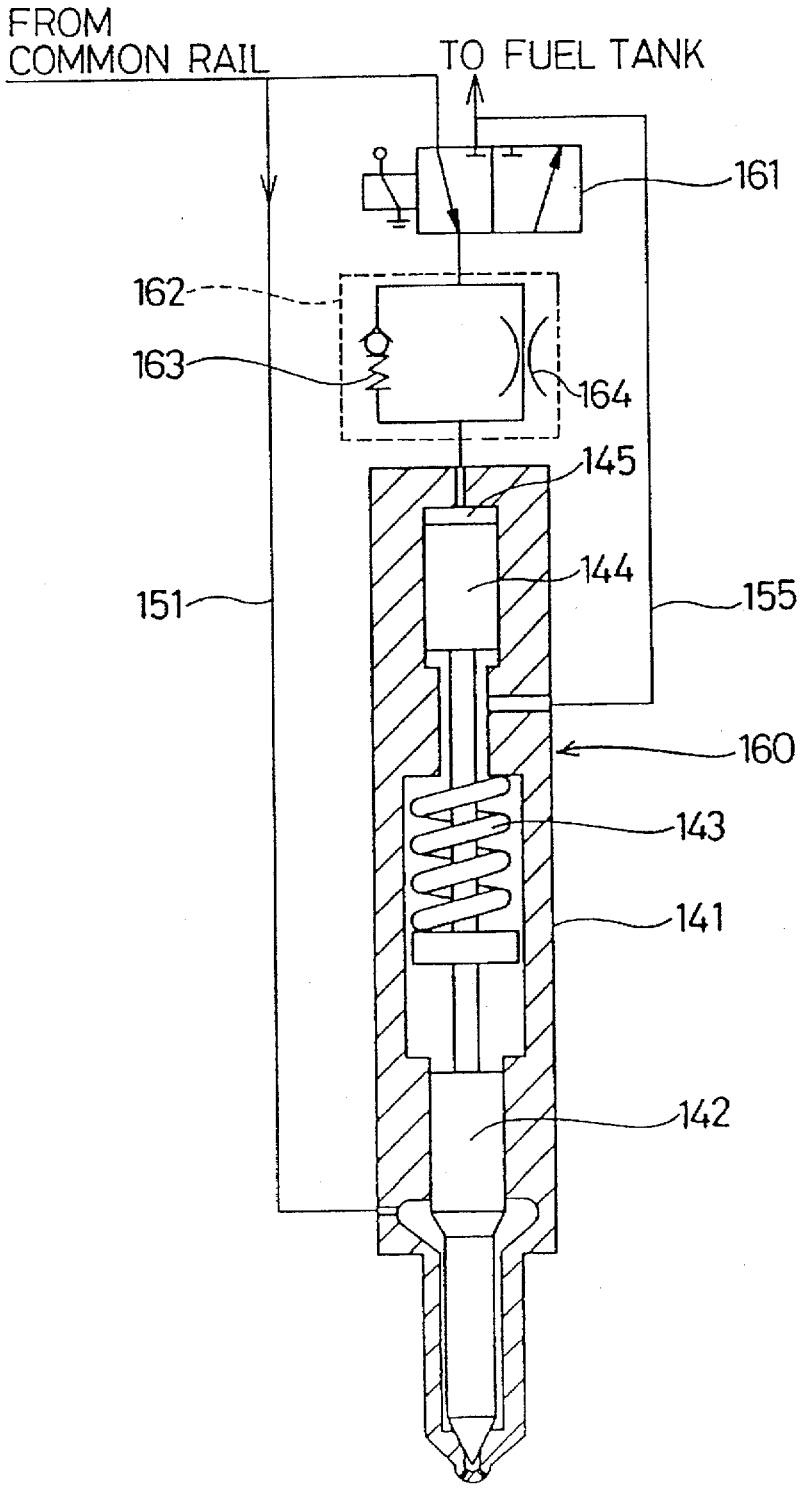
FIG. 13 PRIOR ART
FIG. 13 is a sectional view illustrating another conventional fuel injection apparatus.

FIG. 11 illustrates a modification of the sixth embodiment. FIG. 11 illustrates a sectional view of a retainer 131 in the same position as in FIG. 10. Grooves 132 are formed in the retainer 131 in the axial direction of the retainer at opposing 180° angles, and a round-shaped concave portion 133 is formed in a central portion. Fluid can pass through passages formed by the grooves 132.

The present invention has been described in connection with what are presently considered to be the most practical preferred embodiments. However, the present invention is not meant to be limited to the disclosed embodiments, but rather is intended to include all modifications and alternative arrangements included within the spirit and scope of the appended claims.

What is claimed is:

1. A fuel injection apparatus comprising:

a casing having a sliding hole in an axial direction thereof, a fuel passage for introducing fuel into said casing, an injection opening provided at one end of said sliding hole to inject fuel supplied from said fuel passage, and a control pressure chamber provided at the other end of said sliding hole and for storing fuel supplied from said fuel passage;

a needle valve slidably disposed in said sliding hole, said needle valve having a valve body at one end, said valve body opening said injection opening by fuel supplied to said injection opening through said fuel passage, and a piston at the other end, fuel stored in said control pressure chamber applying pressure to said piston to urge said needle valve in the valve closing direction;

first urging means for urging said needle valve in the valve closing direction;

a valve device for interrupting communication between said fuel passage and said control pressure chamber to seal fuel in said control pressure chamber; and a volume changing device for expanding volume of said control pressure chamber after fuel is sealed in said control pressure chamber by said valve device.

2. A fuel injection apparatus according to claim 1, wherein said valve device includes:

a valve casing having a valve sliding hole therein;

a valve member having a land portion which slides into said valve sliding hole to interrupt communication between said fuel passage and said control pressure chamber;

second urging means for urging said valve member in one direction; and actuating means for actuating said valve member in the other direction resisting said second urging means.

3. A fuel injection apparatus according to claim 2, wherein said volume changing means for expanding volume of said control pressure chamber is configured by said land portion sliding in said valve sliding hole in a manner to expand said control pressure chamber.

4. A fuel injection apparatus according to claim 3, wherein said valve member further includes a fluid resistance portion which throttles a passage area between said second fuel passage and said control pressure chamber before said land portion slides into said valve sliding hole.

5. A fuel-injection apparatus according to claim 2, wherein said valve member is a poppet valve.

6. A fuel-injection apparatus according to claim 2, wherein said valve member is a spool valve.

7. A fuel-injection apparatus according to claim 2, wherein said valve device is a two-position and two-port solenoid valve.

8. A fuel-injection apparatus according to claim 1, wherein said needle valve has a sliding portion which slides in said sliding hole, said sliding portion functions as said piston.

9. A fuel-injection apparatus according to claim 2, wherein said valve member further includes:

a guide portion provided at one side of said land portion for guiding said valve member slidably within said valve casing;

a first connecting portion for connecting said guide portion with said land portion and having a diameter smaller than said land portion; and a seat portion provided at the other side of said land portion and spreading out in said control pressure chamber, said seat portion seating on an opening of said valve sliding hole to said control pressure chamber; and second connecting portion for connecting said seat portion with said land portion;

wherein said fuel passage is open to said valve sliding hole which is enclosed by said first connecting portion, said land portion and said guide portion.

10. A fuel injection apparatus comprising:

a casing having a sliding hole in an axial direction thereof, a fuel passage for introducing fuel into said casing, an injection opening provided at one end of said sliding hole to inject fuel supplied from said fuel passage, and a control pressure chamber provided at the other end of said sliding hole and for storing fuel supplied from said fuel passage;

a needle valve slidably disposed in said sliding hole, said needle valve having a valve body at one end, said valve body opening said injection opening by fuel supplied to said injection opening through said fuel passage, and a piston at the other end, fuel stored in said control pressure chamber applying pressure to said piston to urge said needle valve in the valve closing direction;

first urging means for urging said needle valve in the valve closing direction; and a passage area varying single valve member for varying a passage area between said fuel passage and said control pressure chamber and for selectively closing said passage area to terminate flow therethrough.

11. A fuel injection apparatus according to claim 1, further comprising a passage area varying device for varying a passage area between said fuel passage and said control pressure chamber.

* * * * *